US006130861A

United States Patent [19]

Della Felice

[11] Patent Number: 6,130,861

[45] Date of Patent: Oct. 10, 2000

[54] WRISTWATCH WITH EASILY REPLACEABLE STRAP AND WITH PROP FOR STANDING IT ON A SURFACE

[75] Inventor: Simona Della Felice, Rome, Italy

[73] Assignee: Unoaerre Italia S.p.A., Arezzo, Italy

[21] Appl. No.: 09/121,087

[22] Filed: Jul. 23, 1998

[30] Foreign Application Priority Data

Jul. 31, 1997 [IT] Italy ..... FI970105 U

[51] Int. Cl.[7] ..... G04B 37/14; G04B 37/20

[52] U.S. Cl. ..... 368/276; 368/277; 368/281; 368/282; 368/316; 368/317

[58] Field of Search ..... 368/88, 276, 277, 368/316, 317, 282, 281

[56] References Cited

U.S. PATENT DOCUMENTS

| | | | |
|---|---|---|---|
| 2,221,206 | 11/1940 | Schwankhaus | 368/281 |
| 3,214,685 | 10/1965 | Brenner | 368/276 |
| 4,326,280 | 4/1982 | Perry, Jr. | 368/277 |
| 4,432,654 | 2/1984 | Hesselschwerdt | 368/282 |
| 4,964,092 | 10/1990 | Brida | 368/282 |
| 5,068,840 | 11/1991 | Buckner | 368/281 |
| 5,215,235 | 6/1993 | Maekawa et al. | 368/282 |
| 5,883,860 | 3/1999 | McKay | 368/281 |

OTHER PUBLICATIONS

Corum Suisse Wristwatch; Discover Saint Barthelemy, published Nov. 1998.

*Primary Examiner*—Diego Gutierrez
*Assistant Examiner*—Jeanne-Marguerite Goodwin
*Attorney, Agent, or Firm*—Hopgood, Calimafde, Kalil & Judlowe

[57] ABSTRACT

Behind the watch case (3; 5, 7, 9) is a retaining means (11) which is hinged at one end (17) to said case by a hinge (13) extending transversely with respect to the line of the strap (C), at a limited distance from the rear surface of said case in order to allow the strap to be passed through; said retaining means (11) can be closed against the case in order to grip the strap (which is thus easy to replace) and is positionable at a limited angle with respect to the case, such that it can be stood on a surface like a little table-top clock.

2 Claims, 4 Drawing Sheets

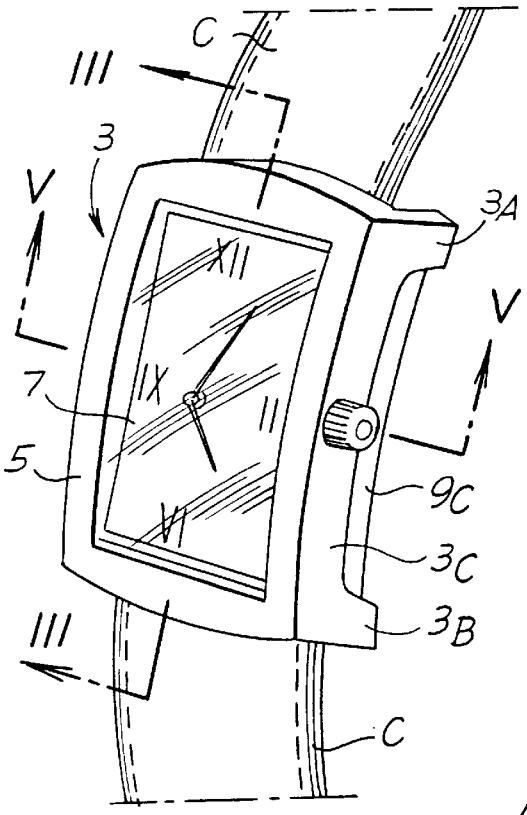
FIG. 1
FIG. 2A
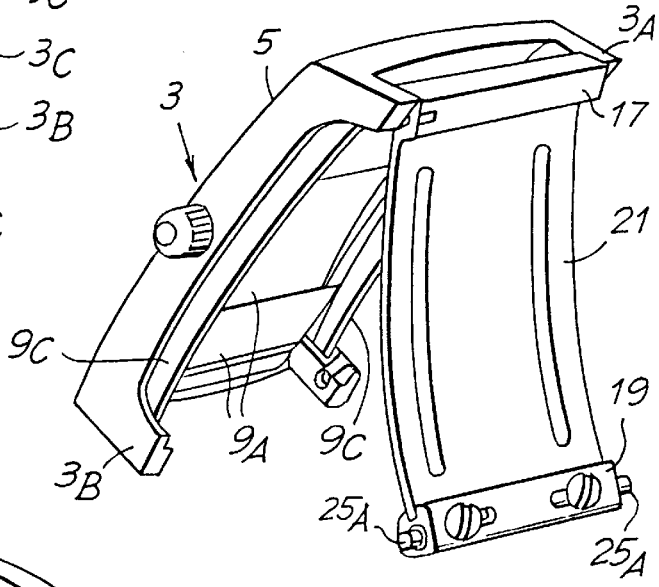
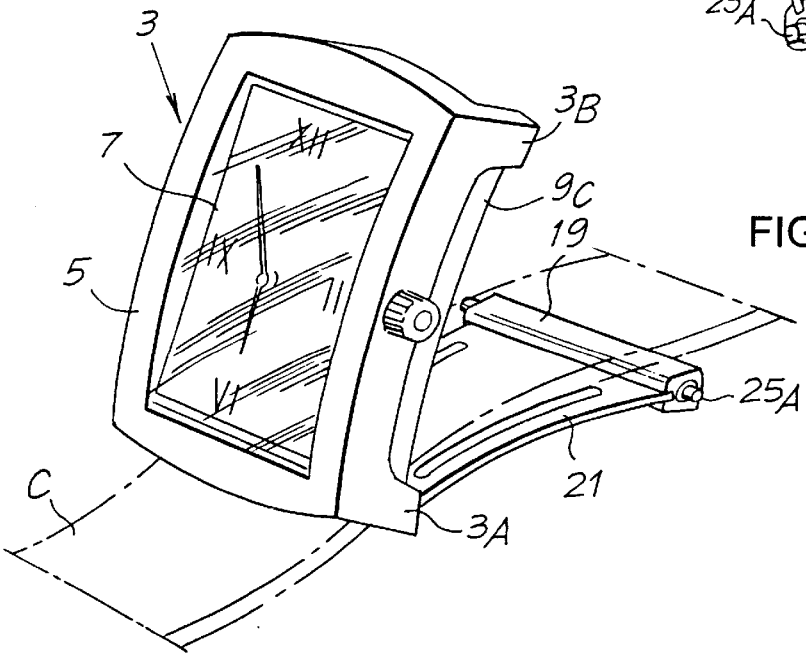
FIG. 2B

VIII
IX
VII
C
$f_C$
3A
31
13
17
5
1A
2
7
1
9
9C
9A
21
11
3K
3
3B
19
25
25B
$f_{11}$
25A 5
3A
13
17
9
31
3
9C

WRISTWATCH WITH EASILY REPLACEABLE STRAP AND WITH PROP FOR STANDING IT ON A SURFACE

DESCRIPTION

The invention relates to a wristwatch. It is an object of the invention to make this watch unusually versatile and suitable for many uses.

STATE OF THE ART

The concept of a watch goes back many years and is believed to have its genesis in Nuremberg, Germany, in about 1500.

Watches were generally referred to as pocket watches until the concept of the wristwatch was developed.

The wristwatch is comprised of a watch ease containing a mechanism for running the watch and includes an adjustable strap of either leather or of a small metal chain or bracelet for attaching the watch to the wrist.

It is not uncommon to remove the wristwatch and place it on a desk or table while a person is reading or working.

The watch essentially comprises, behind the watch case, a retaining means which is hinged at one end to said case transversely with respect to the line of the strap and at a limited distance from the rear surface of this case, in order to allow the strap, which may actually be a metal chain bracelet or the like and which is very easily replaceable, to be passed through; said retaining element can be closed against the case to grip the strap; and in addition said retaining means is positionable at a limited angle with respect to the watch case, such that the watch can be stood on a surface like a little table-top clock.

Advantageously, said retaining means comprises, at the opposite end from the hinge, retaining members engaging with members carried by the case, to provide snap retention and, by the reverse process, release, but by a manual operation.

The retaining means may be of essentially laminar form and have limited elastic deformability.

In order to secure the retaining means in the limited angular position with respect to the case—for the purpose indicated above—there may be at least one spring-loaded retaining pin engaging in an indentation in the vicinity of the hinge.

The case or the back thereof may include, on its rear, two guide walls alongside the lengthwise edges of the strap. With a suitable depression in the back of the case, contact with the strap can be restricted to limited areas adjacent to the strap edges, in order to avoid damage to the central area of the strap, if the latter is a "reed mat" effect bracelet or the like.

OBJECTS OF THE INVENTION

It is an object of the invention to provide a wristwatch capable of being positioned in the upright position on a surface for easy accessability in determining the time of day.

Another object is to provide a wristwatch wherein the band or strap of the watch is cooperatively associated with the means employed in maintaining said watch in the upright position on a surface, such as desk or a table, the strap being thereafter removable.

These and other objects will more clearly appear from the following disclosure, the appended claims and the drawing wherein;

FIG. 1 shows a perspective view in the position for application to the wrist;

FIGS. 2A and 2B show two possible uses in the position for standing it on a surface;

DESCRIPTION OF THE PREFERRED EMBODIMENTS

Figure 3:
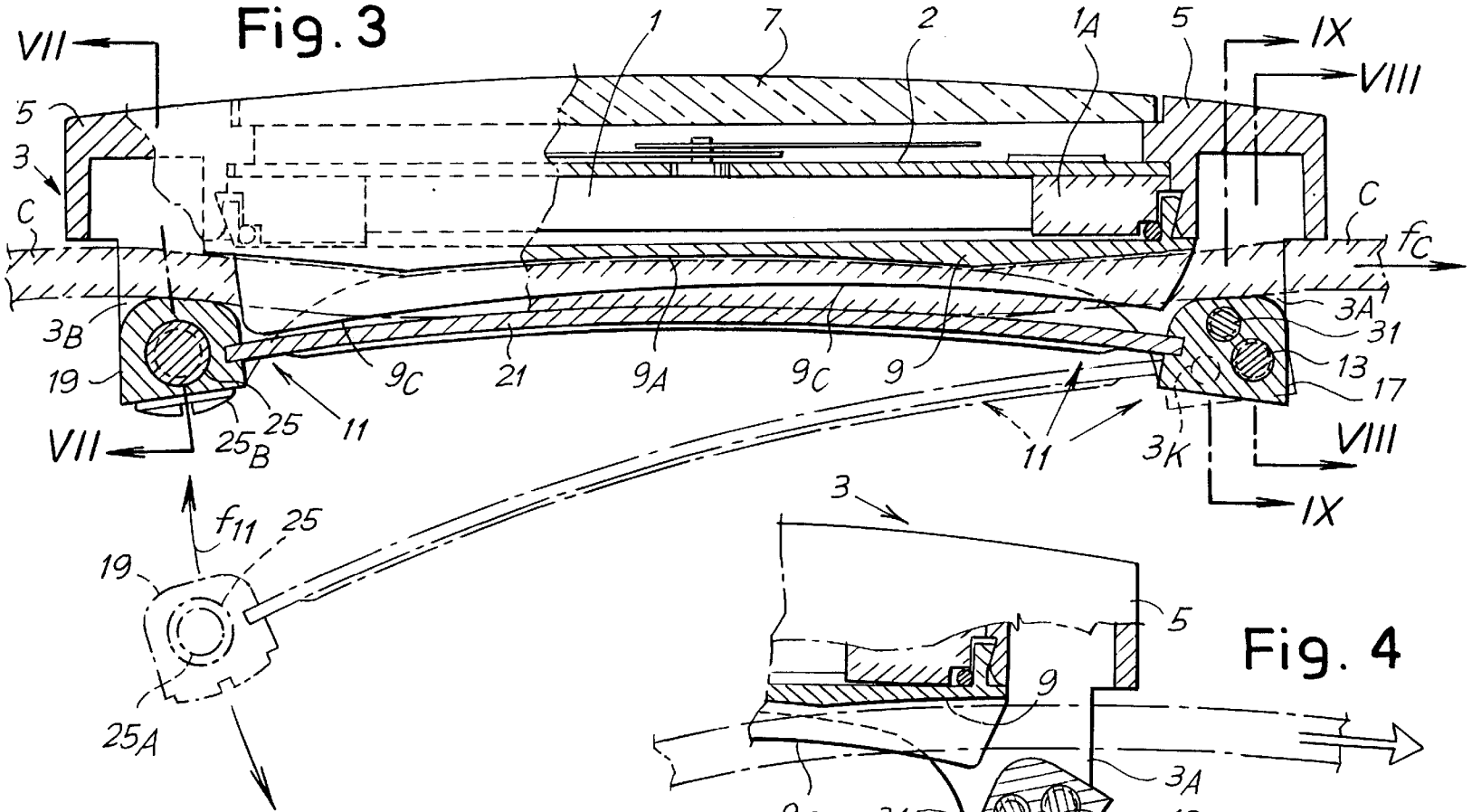
FIGS. 3, 4 and 5 show a section on III—III as marked in FIG. 1, a detail from FIG. 1 in the position of one of FIGS. 2A and 2B and a section on V—V as marked in FIG. 1.
Figure 4:
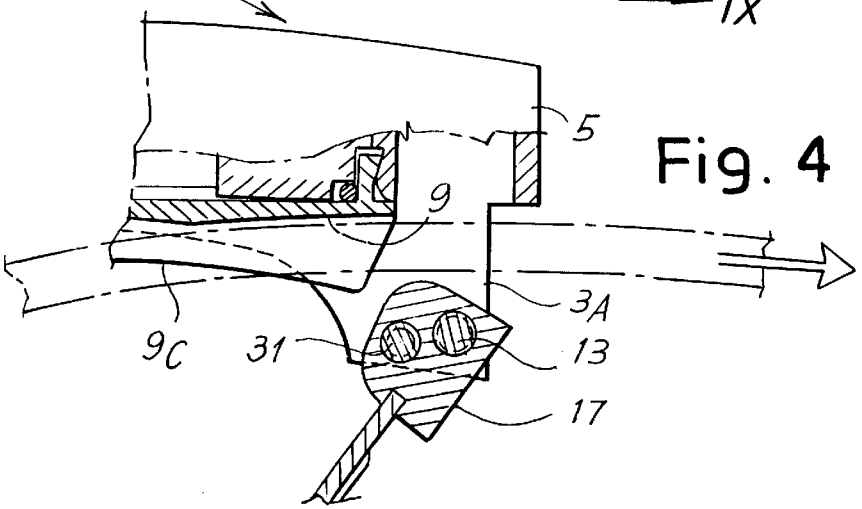
Figure 5:
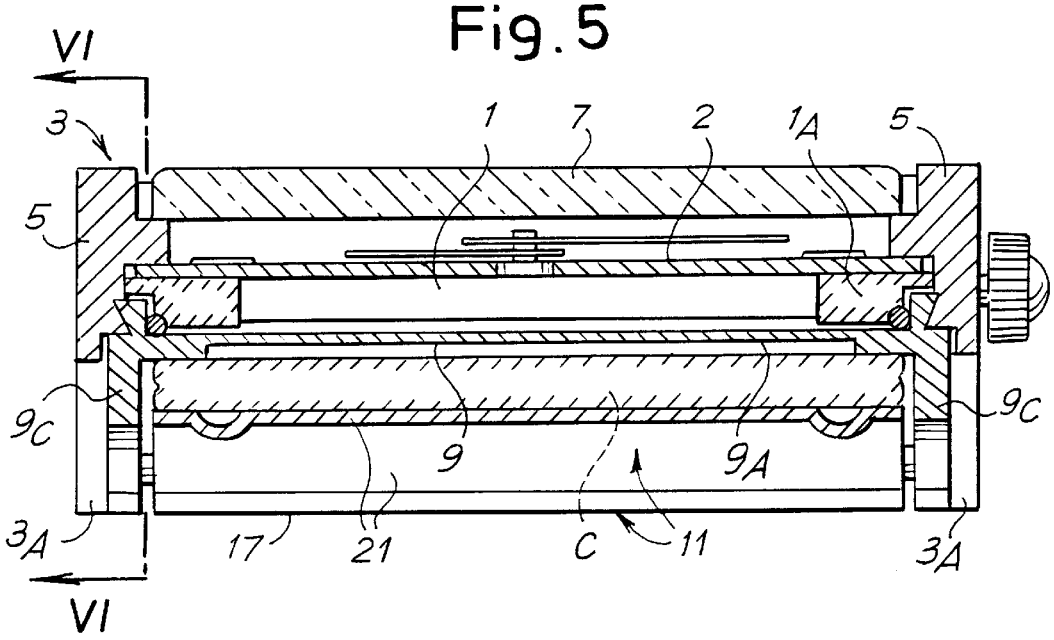
Figure 6:
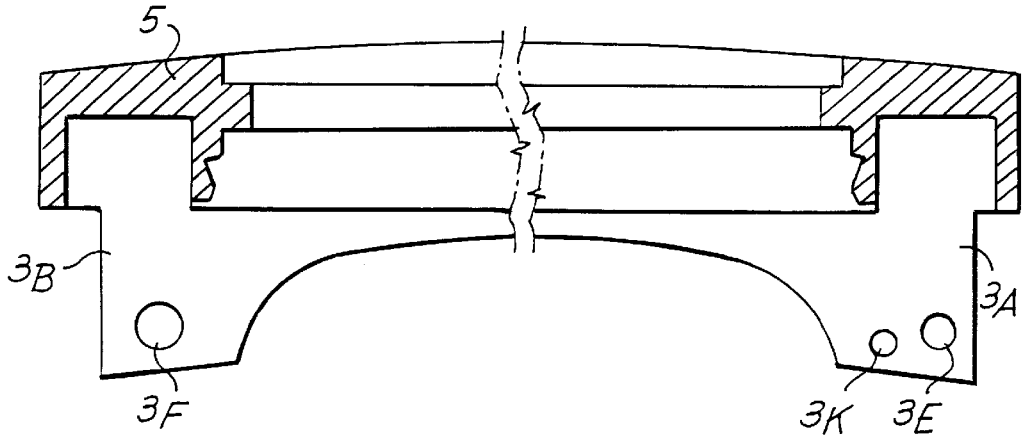
FIG. 6 shows in isolation a bezel frame in the section, that is on VI—VI as marked in FIG. V.

As illustrated in the accompanying drawing, the numeral 1 denotes the watch movement or more generally the time-measuring device, to be combined with a face 2 with hands or with a digital display or an equivalent system. The movement 1 is housed with an intermediate adapter 1A in a case 3 which may be a bezel or frame 5 combined with the crystal 7 enabling the watch face to be read and at the rear with a back 9 suitably shaped for snap engagement with the frame or bezel 5. The reference 9A indicates the rear surface of the case back 9, which surface 9A may be slightly concave on the outer side.

Figure 7:
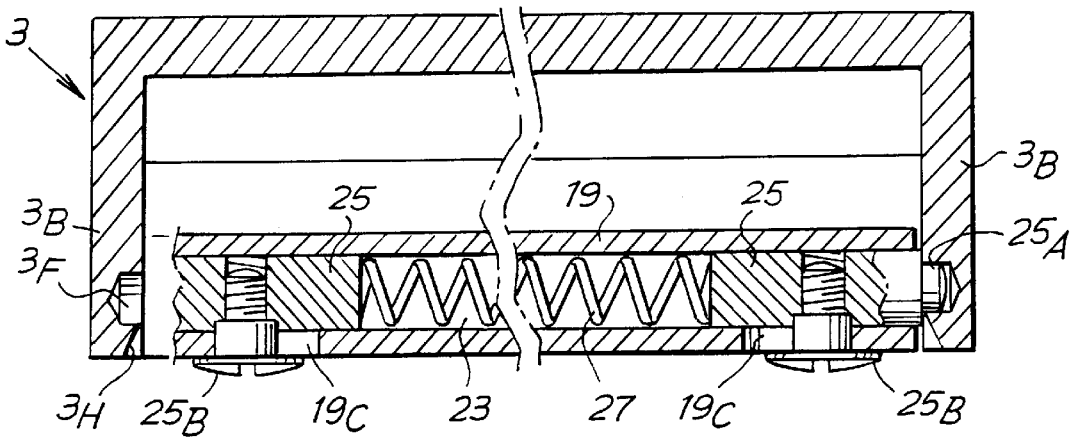
FIGS. 7, 8 and 9 show sections on VII—VII, VIII—VIII and IX—IX as marked in FIG. 3.
Figure 8:
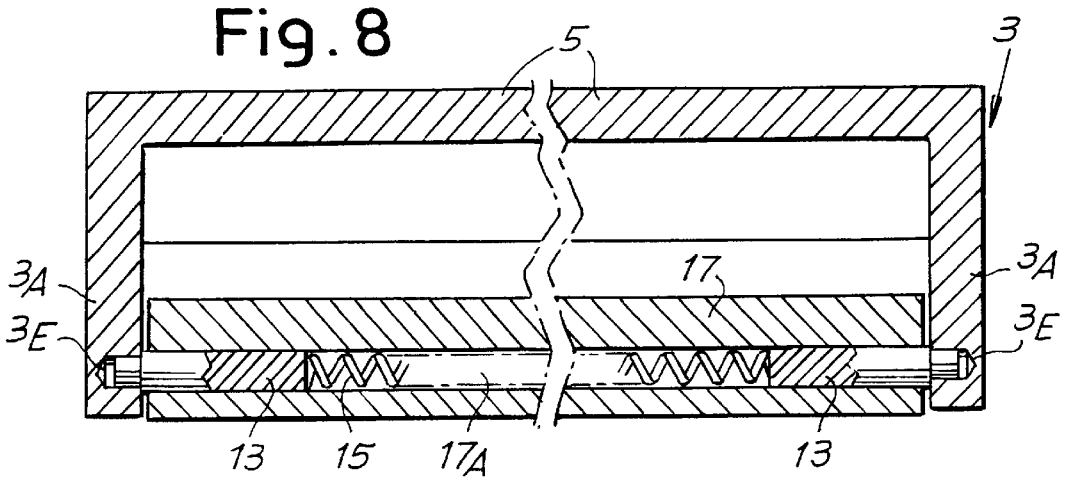

The case 3 includes two pairs of lugs 3A and 3B formed from the frame or bezel 5, for the purposes indicated later. The back 9 includes lengthwise guide walls 9C as a guide for the strap, which may in fact be a bracelet, i.e. a metal mat chain. The lugs 3A serve for hinging the case formed by components 5, 7 and 9—to a retaining means bearing the general reference 11 and appropriately shaped to clamp the strap C, which may be of leather or the like or of metal effectively in the form of a jointed metal mat chain, of traditional bracelet configuration. For this purpose the lugs 3A contain two opposing housings 3C in line with each other to take two spring-loaded pins 13 (see also FIG. 8), which are pushed apart from each other by a spring 15, said spring-loaded pins 13 and said spring 15 being housed in a through hole 17A in a crossbar 17 forming part of said retaining means 11; the through hole 17A and the pins 13 form the hinge for the retaining means 11. At the opposite end from the crossbar 17 is a second crossbar 19 (see also FIG. 7). The two crossbars 17 and 19 are connected by a laminar part 21 which is slightly arched like the surface 9A of the back 9 of the watch case; this laminar part 21 may be elastically flexible. The crossbar 19 contains two coaxial holes or a single through hole 23 in which to house two pegs or plungers 25 which are pushed elastically outward by one spring 27 housed in the through hole 23 or by two separate springs reacting between the bottoms of the blind holes housing the two pegs 25. The outer projections or pins 25A of the pegs 25 are capable of fitting into two opposing indentations 3F, which are formed in the lugs 3B on sloping guide surfaces 3H. Both pegs 25 can be moved, against the action of the spring or springs 27, by means of two lateral projections 25B which may consist of two pins inserted by force and/or adhesive bonding or by screws screwed into the pegs 25 and capable of sliding in slots 19C formed lengthwise in the crossbar 19, thereby permitting limited sliding of the pegs 25.

The retaining means 11, consisting basically of the laminar part 21 and two crossbars 17 and 19, is connected securely to the hinge consisting of the pins 13 and of the indentations 3E formed in the two lugs 3A, so that the retaining means 11 can be pivoted on to the back of the case 3, bringing the crossbar 19 between the two lugs 3B opposite the lugs 3A. In this situation, since the pins 25A of the pegs 25 are shaped so as to be acted upon by the sloping guide surfaces 3H, when the retaining means 11 is closed in the direction of arrow f11 against the back 9 of the case between the two lugs 3B, the pins 25A retreat slightly and then spring out into the indentations 3F formed in the lugs 3B on opposite sides from each other. To release the retaining means 11 from the lugs 3B, the user pushes the lateral projections 25B toward each other against the action of the spring 27, thereby retracting the pins 25A and releasing the retaining means 11 from the indentations 3F of the lugs 3B.

When the retaining means 11 is moved away in the opposite direction to the arrow f11, away from the case back 9, about the axis of articulation defined by the hole 17A and the pins 13, a strap can easily be positioned between the two walls 9C and inserted between the case 5, 7, 9 and the crossbar 17—which stands off the surface 9A of the case back 9 along the line indicated by the arrow fC (in either direction). Once the strap C is in position the retaining means 11 can be lowered again against the case by pivoting it on the hinge consisting of the pins 13 and indentations 3E in order to generate a firm retaining action on the strap C and prevent lengthwise slippage in either direction of the arrow fC; the retaining means 11 is held in the retention position against the watch case by the spring-loaded pins 25A sliding over the profiles 3H and springing out into the indentations 3F of the lugs 3B. Release is effected by retracting the pins 25A by acting on the projections 25B in order to release the retaining means. The opening and closing of the retaining means (11) takes place while the case remains closed.

It is thus easily possible to grip a strap C against the case 5, 7, 9 and release it, or replace it with another strap or bracelet or the like or separate the case from a strap. A strap may consist of a metal mat chain bracelet that can also be used simply as a bracelet.

Figure 9:
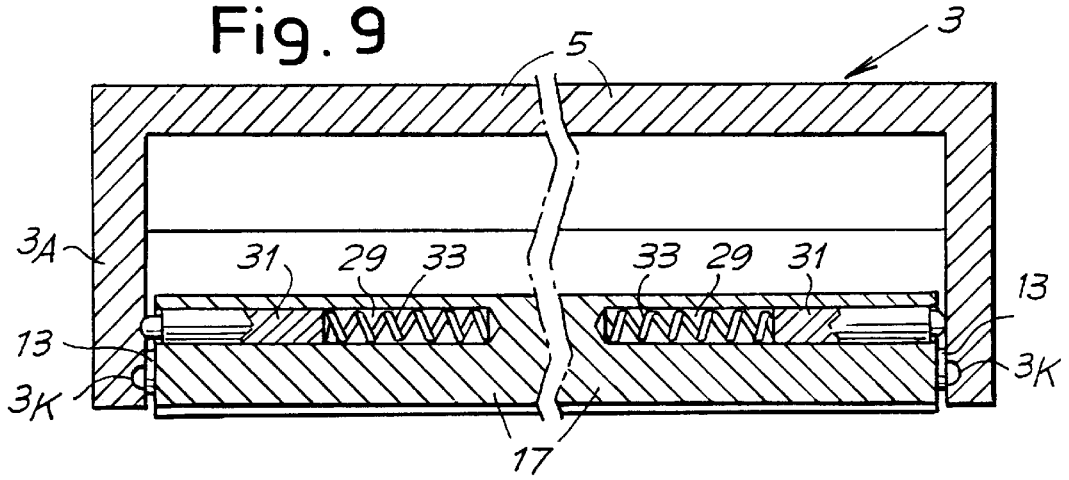

The case—with or without strap—can also be stood on a horizontal surface and used like a little table-top clock. For this purpose it is necessary to provide a support projecting from the case; and this support consists of the same retaining means 11 (composed of members 17, 19 and 21) that can be locked in at least one angular position with respect to the case back, for an angle of about 60° or 30°; it is positioned about the hinge composed of components 13, 17A and 3E; the angular position of the retaining means 11 is locked (see also FIG. 9) by at least one spring-loaded pin which is housed in the crossbar 17 and which engages in at least one indentation 3K in one or each of the lugs 3A that form the hinge for the said retaining means 11. 29 denotes two holes formed in the crossbar 17 or a through hole running along said crossbar to accommodate a spring-loaded pin or two spring-loaded pins 31 which are pushed outward by tiny springs 33 housed in said holes 29 or by a single tiny spring housed in the through hole; the spring-loaded pin or pins 31 can each engage in at least one indentation 3K formed in one or each of the lugs 3A in a position such that, when the spring-loaded pin 31 enters the indentation 3K, it stabilizes the angular position of the retaining means 21 with respect to the case. In this way it forms the support for positioning the watch case in the manner of the body of a little table-top clock, in one or other of the two positions visible in FIGS. 2A and 2B; in the position shown in FIG. 2B in particular, but also in that of FIG. 2A, a strap can still be clamped to the case. The retaining means 11 is easily releasable by overcoming the retaining action of the spring-loaded pin or pins 31.

What is claimed is:

1. A wristwatch comprising a watch case and a strap cooperatively associated therewith for attaching the wristwatch to a wrist, said watch case comprising a pair of top and bottom coinciding portions hinged together by a hinge and having a space therebetween to permit the passage of a strap therethrough, such that when the hinged watch case is closed, the strap is held fast by the wristwatch case, said hinged watch case being characterized by retaining means for supporting said watch in an upright position and retained in that position following removal of the strap, said retaining means being disposed opposite the hinge and having means for providing snap retention of the top and bottom portions of the coinciding portions of said hinged watch case for the removal thereof, said retaining means also including an essentially laminar part having limited deformability, said wristwatch having at least one spring-loaded retaining pin for cooperatively engaging an indentation in the vicinity of the hinge in order to provide limited angular position of the wristwatch in the upright position on a surface, said wristwatch also having a crossbar corresponding to a pivot between the said retaining means and the watch case shaped to increase the amount of available space for insertion of said strap between the case and the crossbar when said retaining means is in an angular position.

2. The wristwatch as in claim 1, wherein the back of said watch case contains an intermediate depression to minimize contact with the strap.

* * * * *